United States Patent [19]

Dickey

[11] 4,335,443

[45] Jun. 15, 1982

[54] ELECTRONIC ANGLE RESOLVER

[76] Inventor: Baron C. Dickey, 982 Yorktown Dr., Sunnyvale, Calif. 94087

[21] Appl. No.: 106,044

[22] Filed: Dec. 21, 1979

[51] Int. Cl.[3] ..... G06G 7/22; G06J 1/00

[52] U.S. Cl. ..... 364/815; 340/347 SY; 364/603; 364/817

[58] Field of Search ..... 364/603, 815, 816, 817, 364/607, 608; 340/347 SY

[56] References Cited

U.S. PATENT DOCUMENTS

| | | | |
|---|---|---|---|
| 3,464,016 | 8/1969 | Kerwin et al. | 364/817 X |
| 3,509,556 | 4/1970 | Schmidt | 364/603 X |
| 3,576,986 | 5/1971 | Brickner et al. | 364/603 |
| 3,984,672 | 10/1976 | Jones | 364/603 X |
| 4,021,658 | 5/1977 | Rhodes | 364/817 X |
| 4,138,729 | 2/1979 | Bayer et al. | 364/603 |

*Primary Examiner*—Joseph F. Ruggiero
*Attorney, Agent, or Firm*—C. Michael Zimmerman

[57] ABSTRACT

The circuit of the angle resolver compares a first angle to a second angle and produces an output voltage which is an analog representation of the angular difference between the two. One of the angles, which might be a controlled variable is represented by a pair of electrical signals from an electronic compass, for example, which are analog representations of the sine and cosine of the angle. Within the angle resolver circuitry, an analog switch and integrator form an output voltage which is accurately proportional to the sine of the angular difference between the two angles in accordance with: sine (A—B)=(sin A) (cos B)—(cos A) (sin B), where B might be the reference angle, and A, the unknown angle. For cases where A is nearly equal to B, A—B is a small angle, and sin (A—B)=A—B. The values of cos B and sin B are very simply linearly approximated in the present invention by the technique of sampling and integrating the sin A and cos A inputs. By the use of RC differentiators at the sin A and cos A inputs to the circuitry, the errors introduced by the linear approximations of cos B and sin B are compensated to a high degree with minimum cost and complexity.

16 Claims, 3 Drawing Figures

ELECTRONIC ANGLE RESOLVER

BACKGROUND OF THE INVENTION

Angle resolvers for comparing a controlled angle to a reference angle in order to give an indication to error or to provide an error signal for use in a feedback control system have existed for a considerable time.

Such systems have used a variety of means of sensing angles and comparing them, such as the crossed coils of the goniometer and various systems employing selsyns to both indicate angles and angular deviations from a reference angle. Also in this category of angle measurement devices might be mentioned the movable scales provided on some compasses to permit direct reading of angle of deviation from a desired heading.

More recently, of course, the development of compact, lightweight, and relatively inexpensive electronics in more-or-less integrated form has made possible the rapid and simple measurement and calculation of the difference between a pair of angles which are presented to the electronic angle resolver in the form of electrical analog signals representing the magnitude and direction of the angles. Such entirely electronic angle resolvers have in particular been proposed for use in the construction of automatic pilots which can steer a steady course in a ship or boat, for example, once given the desired heading.

Such electronic angle resolvers may operate in conjunction with an electronic compass which provides electrical analog signals representative of the sine and cosine of the angle of heading of a boat. Means may also be provided for setting a desired heading, which heading becomes an additional electrical analog signal entered into the electronic angle resolver.

An electronic angle resolver may employ anyone of several approaches available for resolving the angle of heading or its deviation from a desired heading. A resolver may be constructed to make use of any appropriate one of the trigonometric identity formulas depending upon the trigonometric functions of the angles readily available or derivable. The choice among the various techniques depends at least in part on cost, complexity, reliability and angular resolution needed.

If the angular resolver is used as part of a feedback control system or autopilot, all that is needed is the angular deviation (sign and magnitude) of the actual heading as measured from the desired heading. Similarly, many other angle deviation problems in navigation, fire control of weapons, remote positioning of devices for automated production, etc. can be solved by the use of circuitry which determines the deviation of one angle from another.

One attractive approach to the solution of such problems centers around the trigonometric identity $\sin(A-B)=\sin A \cos B-\cos A \sin B$. For example, if A represents an unknown angle to be determined by comparison with a reference angle B, the compass used to indicate A may be easily so arranged as to generate electrical analog signals which are represented of the sine and cosine of A. The apparatus may then be adapted to accept through a manual keyboard or otherwise, a reference angle B against which angle A is to be measured, with the deviation therebetween represented as an electrical analog output signal. Such an angle resolver would be especially useful in an autopilot, for example. In fact, electronic angle resolvers for determining angular deviations are in existence. Unfortunately, their cost and complexity have limited their acceptance. The present application discloses new and useful improvements which significantly lower their cost and improve their reliability without impairing accuracy.

In particular, although it is relatively simple to construct an electronic compass which provides analog voltages which accurately represent the sine and cosine of the angle being measured by the compass, somewhat more complexity is encountered when it is necessary to provide an output voltage which is an accurate analog representation of $\sin(A-B)=\sin A \cos B-\cos A \sin B$, for the derivation of values from such an identity relationship requires the cosine and sine of B together with means to form the two products and to derive the algebraic sum thereof. Although the problem is easily within the scope of a microcomputer, it is desirable to utilize still simpler components to derive the voltage analog of sine (A−B). In this way, the expense and complexity of an electronic angle resolver can be significantly reduced and reliability improved.

SUMMARY OF THE INVENTION

The principal object of the present invention is to provide a reliable, inexpensive electronic angle resolver for providing an analog voltage representation of the difference between a pair of angles.

A second object of the present invention is to provide such an angle resolver having input means to accept analog voltages representing the sine and cosine of one of the angles to be compared by the resolver.

A third object of the present invention is to provide such an angle resolver which derives an analog voltage representation of the angular difference between a pair of angles A and B by means implementing the trigonometric identity $\sin(A-B)=\sin A \cos B-\cos A \sin B$.

A fourth object of the present invention is the provision of an angle resolver according to the immediately preceding object in which the sine and cosine of one of the angles are accurately approximated electronically by simple electrical analog means.

A fifth object of the present invention is the provision of an electronic angle resolver according to the preceding objects which can be simply and inexpensively fabricated from readily available standard active and passive electronic circuit elements.

To the above ends, the electronic angle resolver according to the present invention utilizes a voltage sampling means including an analog electronic switch having four data inputs and a single common data output, a digital input for receiving a binary signal indicative of the one of the four inputs to be connected to the common output, and an enable or inhibit input for permitting (or preventing) operation of the switch.

A gate-and-sample network controlled by a clock generator and connected both to the digital input and inhibit input of the analog switch, incorporates a means to enter one of the angles which are to be compared (typically the reference angle) and to provide corresponding control over the sampling of one or more of the four data inputs of the analog switch.

Analog voltages representative of the sine and cosine of one of the angles are connected to one pair of the four data inputs to the analog switch; the same voltages are also connected through inverters to the other pair of data inputs.

A summing amplifier connected to receive the output voltage of the common data output of the analog switch acts in the role of an integrator and provides an output voltage which is proportional to the sine of the angular difference between the two angles. An RC differentiator at each data input of the analog switch provides error compensation of such a high order that accuracy of one-half degree angular resolution at the output of the summing amplifier can be achieved despite the use of simple circuitry.

The above and other features, objects and advantages of the present invention, together with the best mode contemplated by the inventor thereof for carrying out his invention will become more apparent from reading the following detailed description of a preferred embodiment and perusing the drawing in which:

DETAILED DESCRIPTION OF A PREFERRED EMBODIMENT

Figure 1:
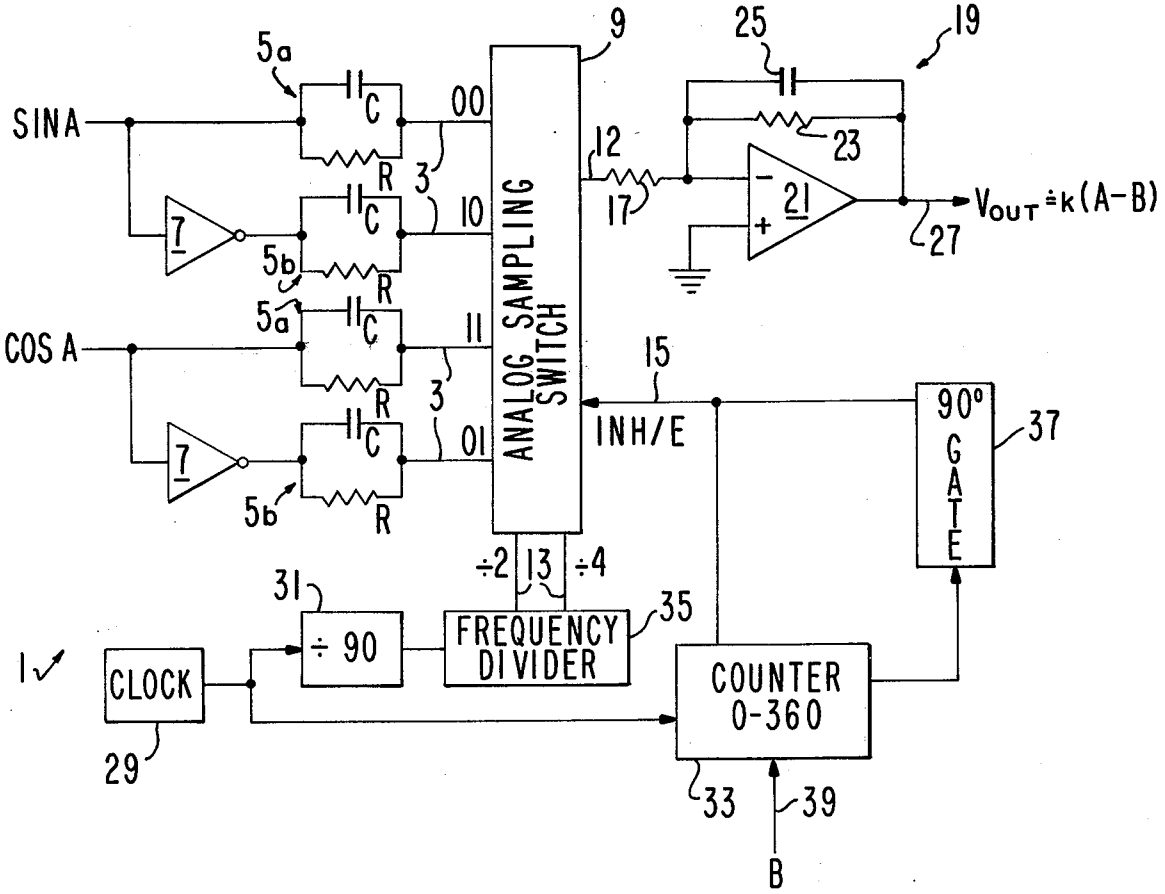
FIG. 1 is a circuit diagram, partly in schematic and partly in block form, illustrating an electronic angle resolver according to the present invention.

In FIG. 1, an electronic angle resolver 1 according to the present invention is illustrated using conventional circuit blocks and some discrete circuit elements. As shown, resolver 1 might form part of an autopilot or auto-compass system in which the angular difference between a desired preselected heading and the heading actually being followed by a boat or airplane are compared. The resulting error voltage can be utilized in a feedback control system in a manner that is well known and will not be discussed further here.

Electronic angle resolver 1 accepts a pair of inputs labeled sin A and cos A which could be derived from any source (not shown) of such signals such as an electronic compass, for example, or other means of providing voltage analogs of the sine and cosine of an unknown angle A. A second input to angle resolver 1 labeled B, could be a voltage proportional to a second angle B to which angle A is to be compared, or it could represent a keyboard or other manual input device into which the number of degrees of angle B is entered or any other suitable known means for entering an angle of reference. The output of angle resolver 1 is labeled $V_{out} \doteq k(A-B)$. That is, for small angular deviations $A-B$ the output is a voltage which is an analog of the difference between angle A and angle B to a very good approximation. As will appear from what follows, the output of angle resolver 1 is, for the general case where $A-B$ is not necessarily small, k sin $(A-B)$.

Within angle resolver 1, the cos A and sin A inputs each connect to one of a pair of differentiators 5*a* and to one of a pair of analog inverters 7. Each inverter 7 is in series with a differentiator 5*b* of identical configuration to differentiators 5*a*.

Each of the differentiators 5*a* and 5*b* is connected to a separate one of the channel data inputs 3 of an analog sampling switch 9. The four data inputs or channels to which the differentiators have been connected have been labeled (in binary notation) from 0–3. Analog sampling switch 9 functions to connect any one of these channel inputs 3 to a common data output 12. The particular one of the inputs 3 which is connected to common output 12 at any given moment of time is determined by a pair of digital control signals at inputs 13. Thus, it will be seen that the four channel data inputs 3 of sampling switch 9 have been labeled for the sake of convenience in terms of the binary combination of 1's and 0's which must be present at digital inputs 13 in order to select the respective channel input.

Analog sampling switch 9 together with differentiators 5*a* and 5*b* and inverters 7 may be thought of as a sampling means to sample the sin A and cos A input voltages.

An inhibit/enable control signal at input 15 permits the analog sampling switch 9 to connect the input channel to common output 12 when "enabled" and prevent this connection when "inhibited". For example, switch 9 can be rendered functional when a logic "1" inhibit/enable control signal is presented to input 15, whereas a logic "0" inhibit/enable control signal would therefore disable switch 9, preventing the connection of any of the input channels to the common output 12. Alternatively, switch 9 could be arranged to permit such connection when a logic "0" is presented at input 15, but prevent such connection when a logic "1" is present at input 15. These entirely similar modes differ only as to the logic involved, the first being known as an enable mode, while the second is commonly known as an inhibit mode. In either case, by suitable logic design the connection of various ones of the channel inputs 3 of switch 9 to its common output 12 may easily be controlled by suitable gating circuitry as will become apparent from what follows.

Common output 12 is connected by means of an input resistor 17 to a summing amplifier 19. At any one time, the resistor 17 is connected by the switch 9 to one of the channel inputs 3 to be coupled in circuit with the parallel connected resistor and capacitor of the differentiator at the one channel input. As explained in further detail hereinafter with reference to FIG. 3, input resistor 17 completes the circuit of each of the differentiators 5*a* and 5*b* and, in addition, forms a voltage divider network with the resistor connected in parallel with the differentiating capacitor of each differentiator. The summing amplifier 19 comprises an operational amplifier 21 having a resistor 23 and a capacitor 25 connected in parallel in a feedback path between angle resolver output 27 and the minus input of operational amplifier 21. As shown, the plus input of operational amplifier 21 is connected to ground. The effect of these connections is to cause summing amplifier 19 to produce an integrated voltage on output line 27 as will appear later in the specification. In other words, summing amplifier 19 acts as an integrating means to continuously integrate the sampler output signals on output line 12.

A clock generator 29 puts out a steady stream of pulses at a fixed frequency to a divide-by-90 network 31 and a gate delay counter 33. The output of divide-by-90 network 31 consists of a steady stream of pulses having exactly 1/90th the basic clock frequency of clock generator 29. These pulses are then fed to a frequency divider 35 having divide-by-2 and divide-by-4 outputs as labeled, connected to digital inputs 13. The divider 35 generates a sequence of four two bit binary address select control signals changing at a rate of 1/90th of the frequency of the clock pulses generated by the clock generator 29. Each address select control signal will, when coupled to the digital inputs 13, cause a particular one of the data inputs 3 to be selected for connection to the output of the sampling switch 9.

The effect of these last connections is that as long as analog sampling switch 9 is in operation as controlled by inhibit/enable input 15, the channel inputs 3 are sequentially connected in regular succession to common output 12 on a continuous basis and at a frequency determined by clock generator 29. In fact, as will become more obvious from the discussion of FIG. 3, each channel data input 3 is addressed, i.e., selected, for sampling for 90 clock pulses.

In actuality, however, the functioning of sampling switch 9 is controlled by means of gate delay counter 33 and a 90° gate 37 . As already noted, the pulses from clock generator 29 form one output of gate delay counter 33. A second input is in the form of a delay input 39 which receives the input of angle B to which angle A is to be compared.

In the simplest case, it might be supposed that delay counter 33 delays the activation of switch 9 one clock pulse for every degree of angle B. If B were 43° for example, gate delay counter 33 would count 43 incoming clock pulses before sending a trigger pulse to 90° gate 37 which would then activate sampling switch 9 by means of an appropriate signal on inhibit/enable input line 15. If, for example, switch 9 were of the type that is actuated by a "0" control signal at input 15 and inhibited by a "1" control signal at the same input, then gate 37 would provide a "1" logic state control signal to input 15 until forty-three clock pulses had occurred whereupon gate 37 would provide a "0" logic state control signal to input 15 for ninety more clock pulses from generator 29, rising to a 1 logic state at input line 15 thereafter.

Figure 3:
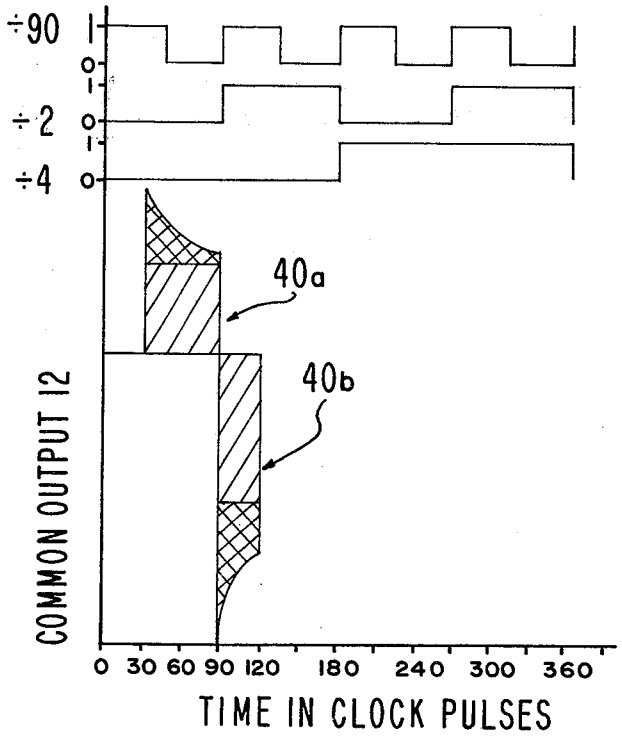
FIG. 3 is a timing diagram showing several waveforms of the present invention.
Figure 2:
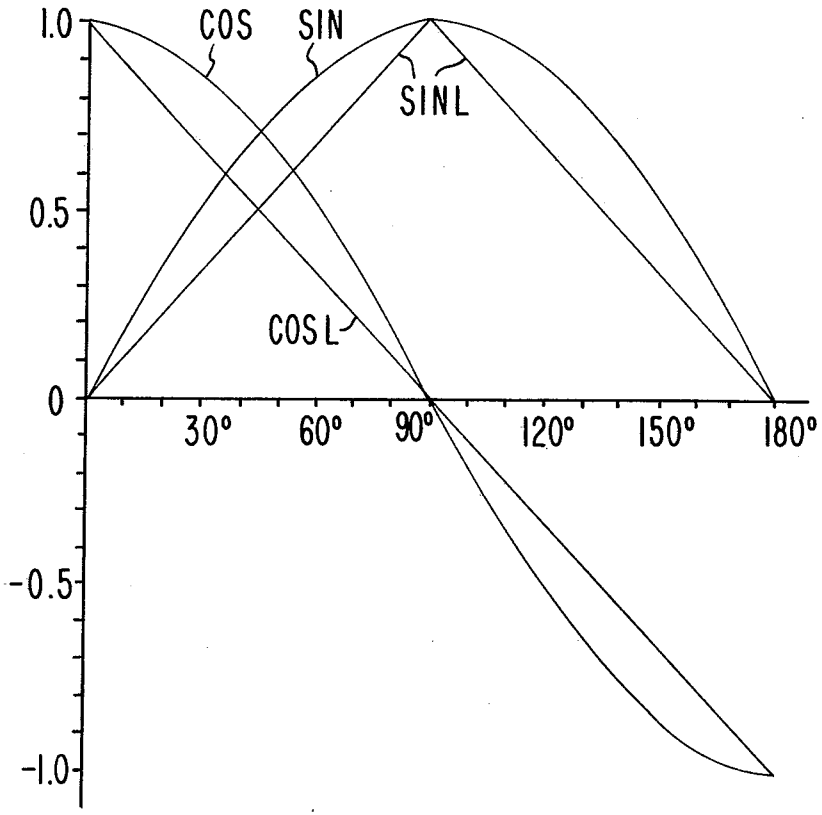
FIG. 2 is a plot of the values of the sine and cosine of angles from 0° to 180°, together with linear approximations thereof according to the present invention.

In order to better understand the effect of these conditions, reference should now be made to FIGS. 2 and 3. In FIG. 2 are shown plots, labeled sin and cos, of the values of the sine and cosine of angles in the range from 0° to 180°. In order that the circuitry of FIG. 1 provide an accurate indication at angle resolver output 27 in the form of a voltage which is an analog representation of the difference between angles A and B, it is necessary that sampling switch 9 be so operated under the influence of the control and address select signals present at its inhibit/enable input 15 and digital inputs 13, that the sine and cosine signals present at the channel data inputs 3 are sampled in such a way as to yield the correct output at resolver output line 27.

As has already been noted earlier in this specification, the means of deriving the value of (A−B) is to sample the sin A and cos A inputs in such a way as controlled by the B input to gate delay counter 33 that solution is carried out according to the trigonometric identity relationship sin (A−B)=sin A cos B−cos A sin B. As noted, sin A and cos A in this formula are readily available from an external source, and are applied through differentiators 5*a* and the data inputs labeled 00 and 11 respectively of switch 9. Moreover, by means of inverters 7, the negatives of these functions, i.e. minus sin A and minus cos A, are made available through differentiators 5*b* to data inputs 10 and 01, respectively, of switch 9. In order to understand how the operation of sampling switch 9 as it is controlled by signals provided at its digital inputs 13 and inhibit/enable input 15 is able to accurately provide a solution to the foregoing trigonometric identity without actually having present the values of cos B and sin B, it is instructive to consider an example:

Suppose that angle A, which might be the course or heading of a boat measured in azimuthal degrees from North, is 30°. Then if angle B, which might be a manually set desired heading is also adjusted to 30°, the output voltage on angle resolver output line 27 should indicate 0, i.e. "no error".

Under these conditions the voltage present at the sin A input is k(sin 30°), which assuming for the sake of simplification that k=1 would be 0.5 volts. Similarly, the voltage present at the cos A input is k(cos 30°)=0.866 volts.

Assuming that gate delay counter 33 operates in a mode to delay the sampling function of sampling switch 9 until a number of clock pulses equal to the number of degrees in angle B has been counted, and starting from time 0, counter 33 would delay for a time equal to 30 clock pulses before initiating the sampling of signals at the data inputs 3 by the sampling switch 9. Assuming that switch 9 is of the type in which a logic "1" at input 15 inhibits the operation of the switch, no voltage would be connected to common output 12 as long as a logic "1" is present at input 15. Consequently in the present example, after the elapse of thirty clock pulses, counter 33 causes a logic "0" to be present at input 15 which enables the switch 9 to sample the signals at the inputs 3. Thereafter, 90° gate 37 continues this enabling logic "0" for the following ninety clock pulses, after which the inhibiting logic "1" is restored at input 15. The total time during which sampling switch 9 actually passes voltages from its binary channel inputs 3 to its common output 12 is thus from clock pulse 30 to clock pulse 120.

During the same time period, clock pulses from generator 29 are also fed to divide-by-90 network 31 and frequency divider 35. As already noted, the clock pulses from clock generator 29 are divided by ninety in network 31, such that the frequency of pulses emerging from this network is only 1/90th of the clock frequency. The clock pulse frequency is further divided by two and by four to form four digital address select control signals coupled to the two digital inputs 13 of switch 9. As a result of these arrangements and again starting from time 0, the digital code at digital inputs 13 will be 00 (selecting the correspondingly labeled channel input of switch 9 for presentation at common output 12) for the first ninety clock pulses, then 01 for the next ninety clock pulses, then 10 for the following ninety clock pulses, and finally 11 for ninety more clock pulses completing a full address select cycle.

In FIG. 3, a timing diagram illustrates the above described operating relationships among divide-by-90 network 31, the two outputs of frequency divider 35, delay counter 33 and 90° gate 37. Although the clock pulse output of generator 29 is not shown, the abscissa axis in FIG. 3 is marked in clock pulses for convenience. Since in our example it was assumed that A=B=30°, switch 9 will actually be activated in the sense to connect its channel inputs 3 serially to its common output 12 only during the ninety clock pulse interval between pulses 30 and 120. The waveform labeled "Common Output 12" in the timing diagram of FIG. 3 illustrates the nature of the voltage wave form which will be produced at output line 12 of switch 9 when A=B=30°. During the first sixty-pulse interval from clock pulses 30 to 90, the channel data input connected to common output 12 is "00", whereas for the last thirty clock pulses of the ninety-pulse sampling interval, the channel data input connected to output 12 is "01".

FIG. 3 shows the resulting output signals on common output line 12. As shown, the output consists of a positive-going sample output signal 40*a* and a negative-going sampler output signal 40*b*. Positive-going signal 40*a* results from gating the sin A input on channel input "00" through the corresponding differentiator 5*a* to common output 12 for the sixty-pulse duration from clock pulse 30 to clock pulse 90. At clock pulse 90, the binary address select signal input presented by frequency divider 35 at digital inputs 13 changes from "00" to "01" as shown by the timing diagram of FIG. 3, gating the corresponding differentiated −cos A input through to output 12, resulting in the generation of signal 40*b*.

Since in our example it was assumed that A=B=30°, the signals 40*a* and 40*b* provided at the common output 12 of the analog sampling switch 9, as integrated by summing amplifier 19, ought to add to zero, indicating "no error". Moreover, they will do so if the areas defined by the plots of the signals at output line 12 for the designated intervals are equal, the area defined by the signal 40*a* being sin A cos B=sin 30 cos 30, and the area defined by the signal 40*b* being −cos A sin B=−cos 30 sin 30. However, it will be obvious that the base lengths of these signals are 60 pulses for signal 40*a* and 30 pulses for signal 40*b*, a ratio of 2/1, rather than cos B/ sin B=cos 30/ sin 30=$\sqrt{3}$. In fact, the base lengths of the two sampler output signals 40*a* and 40*b* are merely linear approximations of the analog cos B and sin B values required in the solution of the trigonometric identity set out earlier in this specification. The values of these linear approximations for angles from 0° to 180° are illustrated by the lines marked "sin 1" and "cos 1" in FIG. 2.

The result of these linear approximations of cos B and sin B prior to the incorporation of differentiators 5*a* and 5*b* was to produce accurate null indications only when A=B=0,45°,90°,135°, etc. For values between these points, the error rose to as much as 5°. Such errors are intolerable in many applications for which such a resolver would be useful. Consequently, some simple, inexpensive, and reliable means of providing adequate compensation of this error was needed. In accordance with the present invention, the connection of each channel data input 3 to a voltage to be sampled through an differentiator 5*a* or 5*b* was found to be a nearly perfect means of compensating for the errors introduced by the linear approximations to the values of sin B and cos B. In effect, as will become apparent from a consideration of the waveform 40*a*–40*b* in FIG. 3, differentiators 5*a* and 5*b* correct for the error in duration of the sampler output signal by a compensatory deviation in amplitude of these signals.

Within the context of the present invention, then, clock generator 29, divide-by-ninety network 31, frequency divider 35, gate delay counter 33, and 90° gate 37 together comprise a timing means which controls the durations of the sampling means 9 in response to the B input at delay input 39.

The insertion of differentiators 5*a* and 5*b* in each of the channel data input lines has been found empirically to reduce the error to less than ½°. Differentiators 5*a* and 5*b* may have values of R chosen to be the same as the value of resistor 17. The corresponding value of C, which is the same for each of differentiators 5*a* and 5*b*, may then be found empirically and will be the value of capacitance which produces the minimum error over the entire 360° range of angles. Alternatively, the resistance and capacitance values for differentiators may both be found analytically, or by analytical approximation followed by empirical adjustment. In this regard, it should be noted that the value of C will be inversely related to the chosen frequency of clock generator 29 such that lower clock frequencies require a larger capacitor.

The effect of the use of differentiators 5*a* and 5*b* has been made clearly visible in FIG. 3 by the use of cross-hatching to show the corresponding portion added to each half of the voltage waveform. As will be apparent to those skilled in the art, perfect compensation has been achieved in our example where A=B, when the positive-going portion of the voltage waveform defines the same area (sum defind by shaded and cross-hatched portions) as that of the negative-going portion of the voltage waveform. Under these circumstances, the two are cancelled perfectly when integrated, giving the desired 0 output voltage.

As illustrated in FIG. 3, the amplitude of each sampler waveform 40*a* and 40*b* initially reaches a peak which is approximately twice the amplitude of the shaded portion of the waveform. Such a condition would occur when the value of each resistor R in the differentiators is chosen approximately the same as the value of input resistor 17 in summing amplifier 19, since the capacitors C in the differentiators would initially bypass the resistors R, coupling the entire leading-edge amplitude to common output line 12. Thereafter the amplitude declines asymptotically to the amplitude of the shaded portion of sampler waveforms 40*a* and 40*b* determined by the resistance values of the two resistors R and 17 of each differentiator 5 forming the voltage divider network.

As is visible in FIG. 3, the effect of the differentiators is to augment a short duration waveform like 40*b* more profoundly than one of longer duration such as 40*a*. By proper choice of components, the effect of the differentiators will be a high degree of error compensation without complex and expensive circuitry. In particular, both the slope of the RC characteristic contributed by differentiators 5*a* and 5*b* and its peak amplitude can be varied by suitable choice of the R and C components.

Those skilled in the art will realize that differentiators 5*a* and 5*b* compensate for the errors introduced through the use of linear approximations for cos B and sin B by a complementary variation in the amplitude of the sin A and cos A sampled signals. It will be obvious therefore that other means besides differentiators 5*a* and 5*b* at the channel inputs 3 could be used. What is essential is to introduce, into the trigonometric identity sin (A−B)=-sin A cos B−cos A sin B, a compensatory error which more or less cancels the error introduced by linear approximations for cos B and sin B.

Although the invention has been described with some particularity in reference to a preferred set of embodiments which, when taken together, comprise the best mode contemplated by the inventor for carrying out his invention, it will be apparent to those skilled in the art that many modifications could be made and many apparently different embodiments thus derived without departing from the scope of the invention. Therefore, the scope of the invention is to be interpreted only from the following claims.

I claim:

1. An electronic angle resolver for accepting electricl analog signals representing an angle A from a source of said signals, one of said signals representing sin A and another of said signals representing cos A, said resolver producing from said sin A and cos A signals an output electrical signal which is an approximate electrical representation of the sin of the angular difference between angle A and a reference angle B, comprising:

sampling means for sampling said sin A and cos A analog signals for a selected interval to produce therefrom at an output respective first and second sampler output signals;

timing means coupled to said sampling means and responsive to said angle B to cause said sampling means to sample said sin A and cos A analog signals for said selected interval at a time determined by the value of said angle B to produce said first and second sampler output singals each of an amplitude, sign and duration to be productive of a product of the amplitude and duration of said first sampler output signal and a product of the amplitude and duration of said second sampler output signal which products have an algebraic sum that is substantially an analog representation of sin A cos B−cos A sin B; and differentiator means connected in the signal path between said source of sin A and cos A signals and the output of said sampling means to superimpose upon each of first and second sampler output signals a differentiated sampler output signal.

2. The angle resolver of claim 1 wherein said differentiator means comprises a capacitor in series circuit relationship in said signal path.

3. The angle resolver of claim 2 wherein said differentiator means includes a first resistor coupled in series with said capacitor and a second resistor coupled in parallel with said capacitor.

4. The angle resolver of claim 1 wherein said sampling means comprises an analog switch having a pair of input channels for connection in circuit with said source of sin A and cos A signals.

5. The angle resolver of claim 1 further including analog inverter means connected in circuit with said sampling means to permit changing said output signal polarity.

6. The angle resolver of claim 5 wherein said sampling means comprises an analog switch having four input channels, two of said channels being inverter input channels and having analog inverter means in circuit therewith.

7. The angle resolver of claim 6 wherein said sampling means comprises: digital input means to accept a digital signal identifying an input channel to be sampled, a common output at which said sampler output signals are presented, and means to connect the channel so identified to said common output for duration determined by the value of said angle B.

8. The angle resolver of claim 7 wherein said sampling means comprises an inhibiting input means which responds to an inhibiting signal applied thereto by preventing the connection of the channel so identified to said common output.

9. An electronic angle resolver for accepting electrical analog signals representing an angle A from a source of said signals, one of said signals representing sin A and another of said signals representing cos A, said resolver producing from said sin A and cos A signals an output electrical signal which is an approximate electrical representation of the sin of the angular difference between angle A and a reference angle B, comprising:

sampling means for sampling said sin A and cos A analog signals for a selected interval to produce therefrom at an output respective first and second sampler ouput signals;

timing means coupled to said sampling means and being provided with means to enter the value of and responsive to said angle B to cause said sampling means to sample said sin A and cos A analog signals for said selected interval at a time determined by the value of said angle B to produce said first and second sampler output signals having durations respectively whose ratio corresponds to the ratio of cos 1 B to sin 1 B where cos 1 B and sin 1 B are linear approximations of the cos B and sin B respectively, said timing means responsive to said angle B to cause said sampling means to produce the first and second sampler output signals each of an amplitude and sign to be productive of a product of the amplitude and duration of said first sampler output signal and a product of the amplitude and duration of said second sampler output signal which products have an algebraic sum that is substantially an analog representation of sin A cos B−cos A sin B; and means in the signal path between the source of sin A and cos A signals and the output of the sampling means to alter the amplitude of the sampler output signals at the output of the sampling means to substantially compensate the approximate representations of the sin B and cos B by the durations of the sampler output signals.

10. The electronic angle resolver of claim 9 wherein amplitude altering means comprises a differentiator circuit interposed in said signal path.

11. The electronic angle resolver of claim 1 or claim 9 further comprising integrating means coupled to receive and integrate sampler output signals and to derive therefrom an electrical output signal which is substantially an analog representation of the sine of the angular difference between said angle A and angle B.

12. An angle resolver for providing an approximate electrical representation of the difference between a pair of angles A and B, the angle A represented by electrical signals provided by a source and which correspond to the sin A and cos A, comprising:

sampling means for selectively sampling electrical signals for a selected interval received at an input thereof responsive to the sin A and cos A electrical signals provided by the source of same to produce sampler output signals at an output; said source and sampling means coupled together to define a signal path from said source to said output;

differentiator means for generating differentiated forms of received electrical signals connected to the signal path between the source and the output to effect the production of sampler output signals corresponding to differentiated forms of the sin A and cos A electrical signals; and timing means coupled to the sampling means and responsive to the value of the angle B to cause said sampling means to sample said sin A and cos A electrical signals for said selected interval at a time determined by the value of said angle B to effect the production of sampler signals, with the effects of differentiation, corresponding to the angular difference between angles A and B.

13. The angle resolver of claim 12 further comprising integrating means having an input coupled to the output of the sampling means to receive the sampler output signals and derive therefrom a signal which is an analog representation of the angular difference between angles A and B.

14. The angle resolver of claim 12 wherein the timing means includes a first generator means for generating a sequence of select signals in regular succession, the sampling means is coupled to said first generator means to receive said sequence of select signals and is responsive thereto to receive for sampling in a corresponding sequence electrical signals representative of the sin A and cos A; and a second generator means having an input for receiving a signal representative of the value of angle B and generating therefrom a control signal corresponding to said value of angle B, the sampling means is coupled to said second generator means to receive said control signal and is responsive thereto to sample the sin A and cos A electrical signals for the selected interval and a time determined by the control signal and provide at its output samples of the received sin A and cos A representative electrical signals having durations corresponding to the value of the angle B represented by said control signal.

15. The angle resolver of claim 14 wherein sampling means includes a switch having four inputs and one output, said switch is responsive to the first generator means to receive for sampling and coupling to said one output sequentially in regular succession signals at separate ones of said four inputs; and the differentiator means includes a separate differentiator circuit each having an input coupled in series with one of the four inputs of the switch and a separate signal inverter coupled in series with two of the separate differentiator circuits whereby the sampling means provides electrical signals at its output which are differentiated forms of the sin A and cos A, a first differentiator circuit with series coupled inverter and a second differentiator circuit without the series coupled inverter coupled to receive the sin A electrical signal, and the other two of the four differentiator circuits and other one of the two inverters coupled to receive the cos A electrical signal.

16. The angle resolver of claim 15 wherein the second generator means includes a counter having a first input for receiving and counting pulses and a second input for receiving the signal representative of the value of angle B, a selected number of pulses representing one degree, said counter responsive to received pulses and said angle B value representative signal to effect generation of the onset of the control signal when said counter counts a number of pulses corresponding to the represented value of angle B, and means for effecting termination of the control signal a duration after the generation of the onset of said control signal corresponding to the occurrence of a number of pulses representative of ninety degrees, the duration of said control signal corresponding to the select interval; and each of the select signals has a duration corresponding to the number of pulses representative of ninety degrees.

* * * * *